US008544648B2

(12) United States Patent
Cleveland et al.

(10) Patent No.: US 8,544,648 B2
(45) Date of Patent: Oct. 1, 2013

(54) SYSTEM FOR STACKING ARCHIVE BOXES INCLUDING A FIRE-RESISTANT DRYWALL SUPPORT SHELL

(75) Inventors: Terri P. Cleveland, Holley, NY (US); Kelvin H. Wildman, Honeoye Falls, NY (US); Douglas O. Nichol, Walworth, NY (US)

(73) Assignee: John D. Brush & Co., Inc., Rochester, NY (US)

( * ) Notice: Subject to any disclaimer, the term of this patent is extended or adjusted under 35 U.S.C. 154(b) by 352 days.

(21) Appl. No.: 12/837,968

(22) Filed: Jul. 16, 2010

(65) Prior Publication Data

US 2012/0012493 A1 Jan. 19, 2012

(51) Int. Cl.

| | |
|---|---|
| ***B65D 21/00*** | (2006.01) |
| ***B65D 85/62*** | (2006.01) |
| ***B65D 21/02*** | (2006.01) |
| ***B65D 85/00*** | (2006.01) |

(52) U.S. Cl.

USPC ..... 206/508; 206/503; 206/509; 206/511; 220/23.87; 220/23.88; 220/23.89; 220/215; 220/521; 220/560.01; 220/592.2

(58) Field of Classification Search

USPC ..... 206/503, 508, 509, 511; 220/23.6, 220/23.87, 23.88, 23.89, 215, 521, 522, 560.01, 220/592.2, 623, 627, 669

See application file for complete search history.

(56) References Cited

U.S. PATENT DOCUMENTS

| | | | | |
|---|---|---|---|---|
| 2,647,653 | A * | 8/1953 | Dube | 220/592.2 |
| 4,225,045 | A * | 9/1980 | Rayner et al. | 206/508 |
| 4,721,227 | A * | 1/1988 | Hughes et al. | 220/560.01 |
| 6,040,526 | A * | 3/2000 | Olzak | 174/544 |
| 6,244,458 | B1 * | 6/2001 | Frysinger et al. | 220/592.09 |
| D627,562 | S | 11/2010 | Osiecki et al. | |
| 2009/0004459 | A1 * | 1/2009 | Kipp et al. | 428/318.4 |

OTHER PUBLICATIONS

Osiecki, Scott, W., et al, "Archive Box," U.S. Appl. No. 29/365,937, filed Jul. 16, 2010.

* cited by examiner

*Primary Examiner* — Anthony Stashick
*Assistant Examiner* — Madison L Poos
(74) *Attorney, Agent, or Firm* — Woods Oviatt Gilman LLP

(57) ABSTRACT

A system for stacking fire-resistant archive boxes on top of one another is provided. Each of the archive boxes comprise an outer shell, an inner shell disposed within the outer shell, a drywall support shell, and a lid. The inner shell has an opening defining a storage compartment, and is spaced apart from the outer shell defining a cavity therebetween. The inner shell includes a bottom wall and side walls. The drywall support shell is disposed within the cavity and surrounds a substantial portion of the inner shell. The lid is configured to be disposed over the opening in the inner shell to selectively enclose the storage compartment. The drywall support shell of the upper archive box is substantially aligned with the drywall support shell of the lower archive box whereby the lower archive box is supportive of the upper archive box.

21 Claims, 10 Drawing Sheets

SYSTEM FOR STACKING ARCHIVE BOXES INCLUDING A FIRE-RESISTANT DRYWALL SUPPORT SHELL

BACKGROUND OF THE INVENTION

The present invention relates to a system for stacking archive boxes; more particularly, the present invention relates to a system for stacking at least one archive box on top of another archive box, wherein each archive box includes a fire-resistant drywall support shell that protects the contents being stored therein from fire damage, while at the same time reducing the chance that the lower archive box will collapse under a load imposed by the archive boxes stacked thereon.

Archive boxes are used to store documents, files, office supplies, and other valuable items. An archive box typically includes a bottom container portion and a lid, which may be formed of cardboard or plastic. The bottom container portion is typically filled with items, the lid is placed on top of the bottom container portion to enclose the items within the archive box, and then the archive box placed in storage so that it may be accessed at a later date. It is not uncommon for archive boxes to remain in storage without being accessed for a long period of time.

As archive boxes are placed in storage, they are ordinarily stacked on top of on another in order to conserve storage space. However, due to the cumulative weight of the items contained within the archive boxes being stacked, the bottom-most archive boxes are susceptible to being crushed over time, thereby risking damage to the items contained within those particular boxes. Most existing archive boxes fail to provide adequate structural rigidity to support heavy loads over an extended period of time. In addition, the inadequate thermal resistance of existing archive boxes is a concern in the instance of a fire. The heat produced by a fire will rapidly burn a cardboard archive box and melt a plastic archive box, thereby exposing the items contained within those boxes to high temperatures leaving little opportunity to save the items from being destroyed by the fire.

As such, there is a need for system for stacking archive boxes that will reduce the possibility of the bottom-most archive boxes from being crushed. There is also a need for a system for stacking archive boxes that will also adequately protect the items contained within the archive boxes in the event of a fire. The present invention addresses these needs as well as other needs.

BRIEF SUMMARY OF THE INVENTION

In order to overcome the above stated problems and limitations herein is provided a system for stacking two or more archive boxes on top one another. The archive boxes included in the system comprise an outer shell, an inner shell disposed within said outer shell, a drywall support shell, and a lid. The inner shell has an opening defining a storage compartment, and is spaced apart from the outer shell to form a cavity therebetween. The inner shell also includes a bottom wall and at least one side wall. The drywall support shell is disposed within the cavity and surrounds a substantial portion of the inner shell. The drywall support shell includes a bottom wall positioned adjacent to the bottom wall of the inner shell, and at least one side wall positioned adjacent to the at least one side wall of the inner shell. The lid is configured to be disposed over the opening in the inner shell to selectively enclose the storage compartment. The at least one side wall of the drywall support shell of a first archive box is substantially aligned with the at least one side wall of the drywall support shell of a second archive box whereby the second archive box is supportive of the first archive box.

The system may also be configured so that the at least one side wall of the first archive box is coplanar with the at least one side wall of the second archive box. Further, the first archive box may include at least one support foot extending from the outer shell, and the second archive box may include an indentation in the lid configured for receiving the at least one support foot to properly orient the first and second archive boxes relative to one another.

The bottom wall of the inner shell of each of the archive boxes may include an outer surface, wherein at least one first rib extends outwardly from the outer surface. The at least one first rib is in contact with the bottom wall of the drywall support shell to off-space the bottom wall of the drywall support shell from the outer surface of the bottom wall of the inner shell. The at least one side wall of the inner shell of each of the archive boxes may include an outer surface, wherein at least one second rib extends outwardly from the outer surface. The at least one second rib is in contact with the at least one side wall of the drywall support shell to off-space the at least one side wall of the drywall support shell from the outer surface of the at least one side wall of the inner shell.

The outer shell of each of the archive boxes may include a bottom wall and at least one side wall. The bottom wall of the outer shell of each of the archive boxes may include an inner surface, wherein at least one third rib extends outwardly from the inner surface. The at least one third rib is in contact with the bottom wall of the drywall support shell to off-space the bottom wall of the drywall support shell from the inner surface of the bottom wall of the outer shell. The at least one side wall of the outer shell of each of the archive boxes may include an inner surface, wherein at least one fourth rib extends outwardly from the inner surface. The at least one fourth rib is in contact with the at least one side wall of the drywall support shell to off-space the at least one side wall of the drywall support shell from the inner surface of the at least one side wall of the outer shell.

Each of the archive boxes may further include a thermal reflectant layer, such as, for example, aluminum foil or stainless steel, that surrounds a substantial portion of the drywall support shell, wherein the metallic barrier is positioned between the drywall support shell and the outer shell to reflect heat produced in the event of a fire.

The lid on each of the archive boxes may include a lid bucket defining a fill cavity, a cover coupled with the lid bucket to enclose said fill cavity, and fire-resistant insulation positioned within the fill cavity. The lid bucket may include a bottom wall having at least one fill protrusion extending therefrom. The cover may include an inner surface having at least one brace protrusion extending therefrom positioned to contact the at least one fill protrusion on said lid bucket to increase the rigidity of the lid. Further, the inner surface of the cover may include at least one snap protrusion extending therefrom, wherein the lid bucket includes at least one receiving slot defined therein configured to receive the snap protrusion to fasten the cover to the lid bucket.

In another aspect, there is provided a system for stacking a first archive box on top of a second archive box, wherein the first and second archive boxes each comprise an outer shell, an inner shell, a drywall support shell, a thermal reflectant layer, and a lid. The outer shell includes a bottom wall and at least one side wall, the outer shell including at least one support foot extending therefrom. The inner shell includes a bottom wall and at least one side wall, the inner shell disposed within the outer shell and having an opening defining a storage compartment. The inner shell is spaced apart from the outer shell and defines a cavity between the inner shell and the outer shell. The drywall support shell is disposed within the cavity and surrounds a substantial portion of said inner shell, The drywall support shell includes a bottom wall spaced apart from the bottom wall of the inner shell and the bottom wall of the outer shell. The drywall support shell includes at least one side wall that is spaced apart from the at least one side wall of the inner shell and the at least one side wall of the outer shell. The at least one side wall of the drywall support shell includes an end portion, the bottom wall of the drywall support shell includes a top surface, wherein the end portion is in contact with the top surface. The thermal reflectant layer surrounds either all, or a substantial portion, of the drywall support shell and is positioned between the drywall support shell and the outer shell. The lid is configured to be disposed over the opening in the inner shell to selectively enclose the storage compartment. The lid also has an indentation defined therein configured for receiving the at least one support foot of the first archive box. The at least one side wall of the drywall support shell of the first archive box is substantially vertically aligned with, or positioned inwardly of, the at least one side wall of the drywall support shell of the second archive box whereby the second archive box is supportive of the first archive box.

A further aspect of the invention includes a system for stacking a first archive box on top of a second archive box, wherein the first archive box and the second archive box each comprise an outer shell including a bottom surface, an inner shell disposed within the outer shell, a drywall support shell, and a lid. The inner shell has an opening defining a storage compartment, and is spaced apart from the outer shell thereby defining a cavity between the inner shell and the outer shell. The inner shell includes a bottom wall and first and second opposing side walls. The drywall support shell is disposed within the cavity and surrounds a substantial portion of the inner shell. The drywall support shell includes a bottom wall positioned adjacent to the bottom wall of the inner shell, and at least first and second opposing side walls positioned adjacent to the first and second opposing side walls of the inner shell, respectively. The lid is configured to be disposed over the opening in the inner shell to selectively enclose the storage compartment. The bottom surface of the outer shell of the first archive box is in contact with the lid of the second archive to form at least one load transmission point that is positioned inwardly of the first and second opposing side walls of the drywall support shell of the second archive box whereby the second archive box is supportive of the first archive box.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
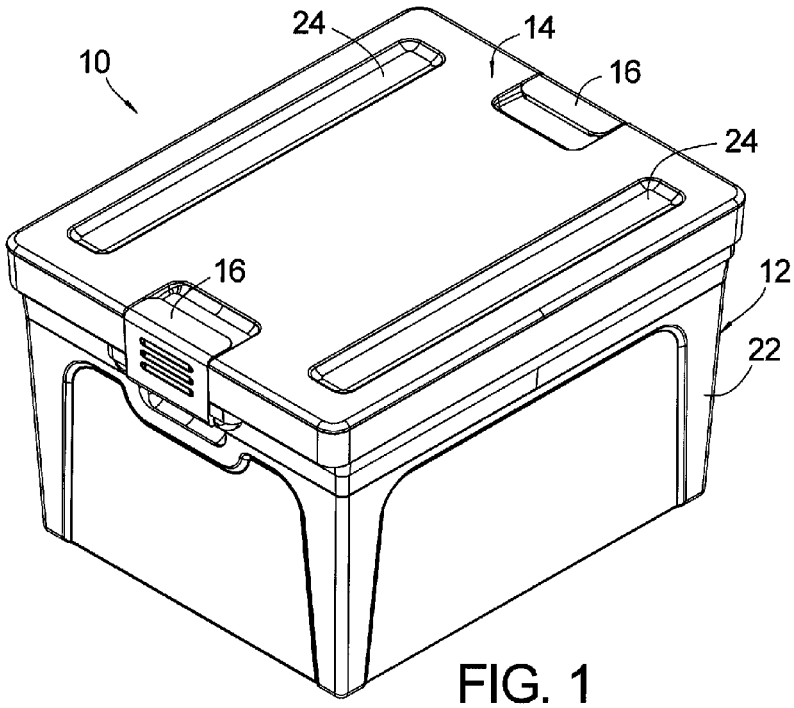
FIG. 1 is a front perspective view of a stackable archive box in accordance with the present invention.
Figure 2:
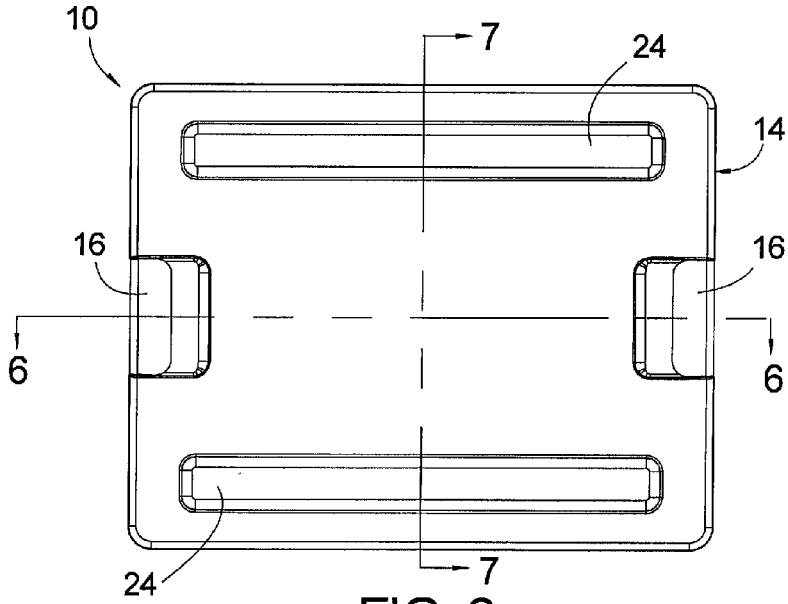
FIG. 2 is a top view of the archive box shown in FIG. 1.
Figure 3:
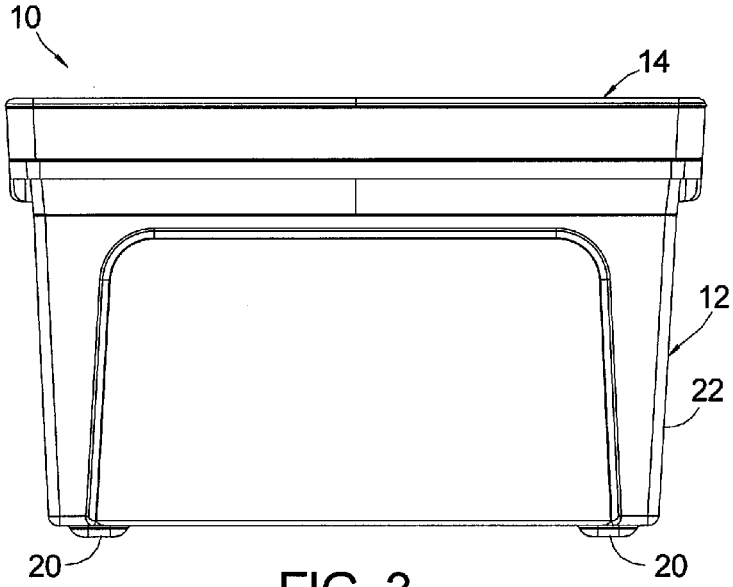
FIG. 3 is a side view of the archive box shown in FIG. 1.
Figure 4:
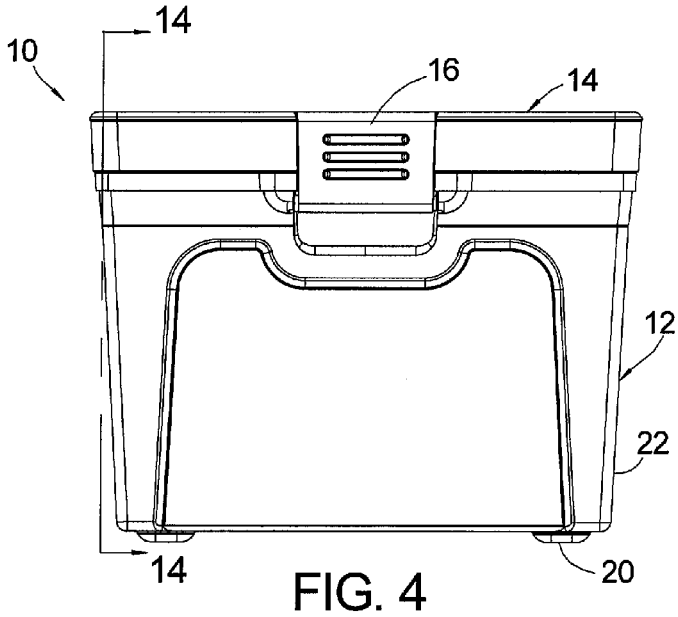
FIG. 4 is a front view of the archive box shown in FIG. 1.

Referring now to the drawings in detail, and initially to FIGS. 1-4, reference numeral 10 generally designates a stackable archive box that may be used in accordance with the present invention. The archive box 10 includes a base assembly 12 and a lid 14 that may be selectively attached to base assembly 12 using a pair of latches 16. Latches 16 may be pivotally attached to either base assembly 12 or lid 16 so that lid 14 may be removed or secured to base assembly 12 to enclose or allow access to a storage compartment 18 (FIG. 5) defined by base assembly. As best seen in FIGS. 3 and 4, base assembly 12 may include at least one support foot 20 extending from an outer shell 22 of base assembly 12. As best seen in FIGS. 1 and 2, lid 14 may include at least one indentation 24 defined therein configured for receiving a support foot on an archive box that is positioned on top of archive box 10 to properly align the archive boxes relative to one another.

Figure 5:
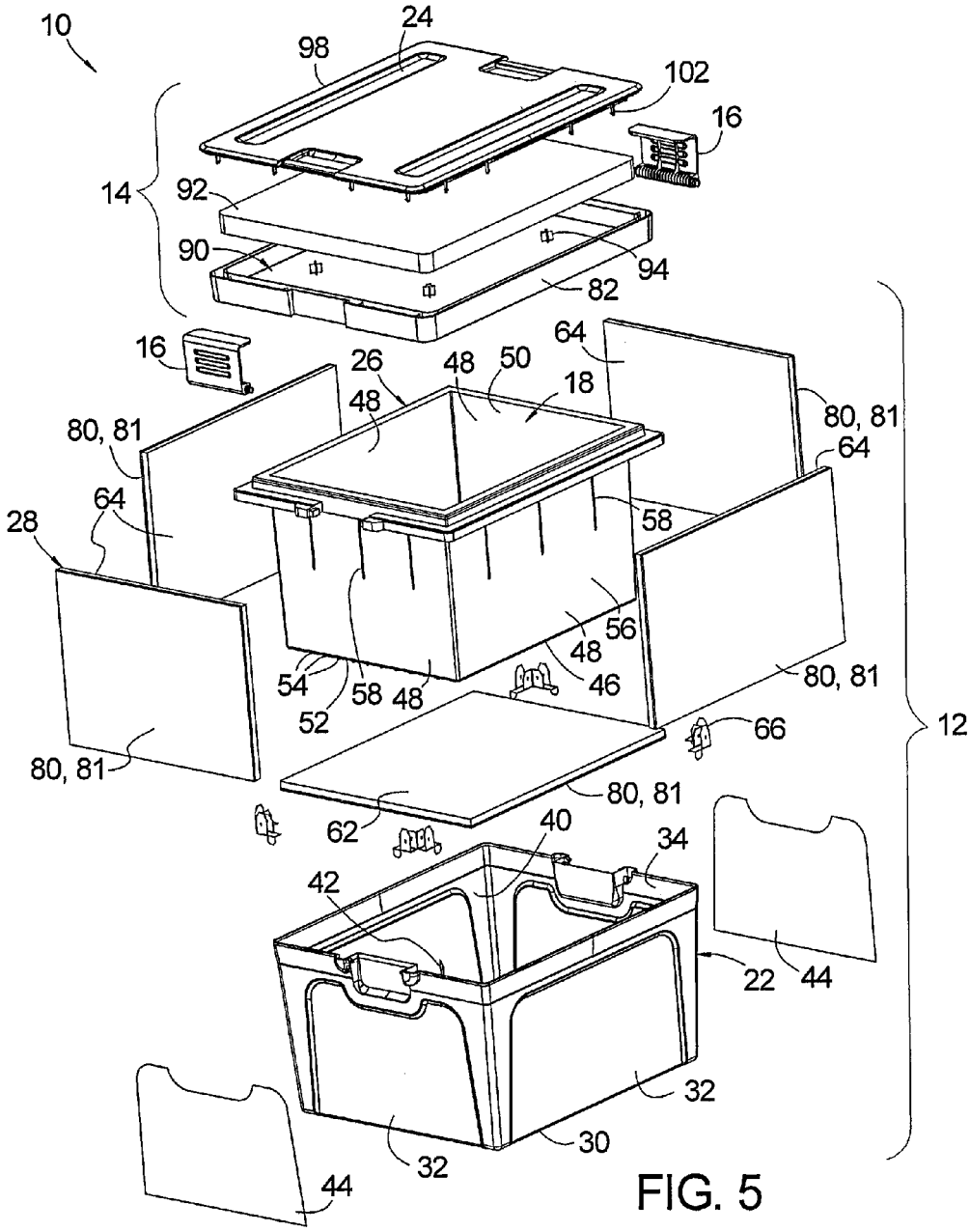
FIG. 5 is a partial exploded view of the archive box shown in FIG. 1.
Figure 6:
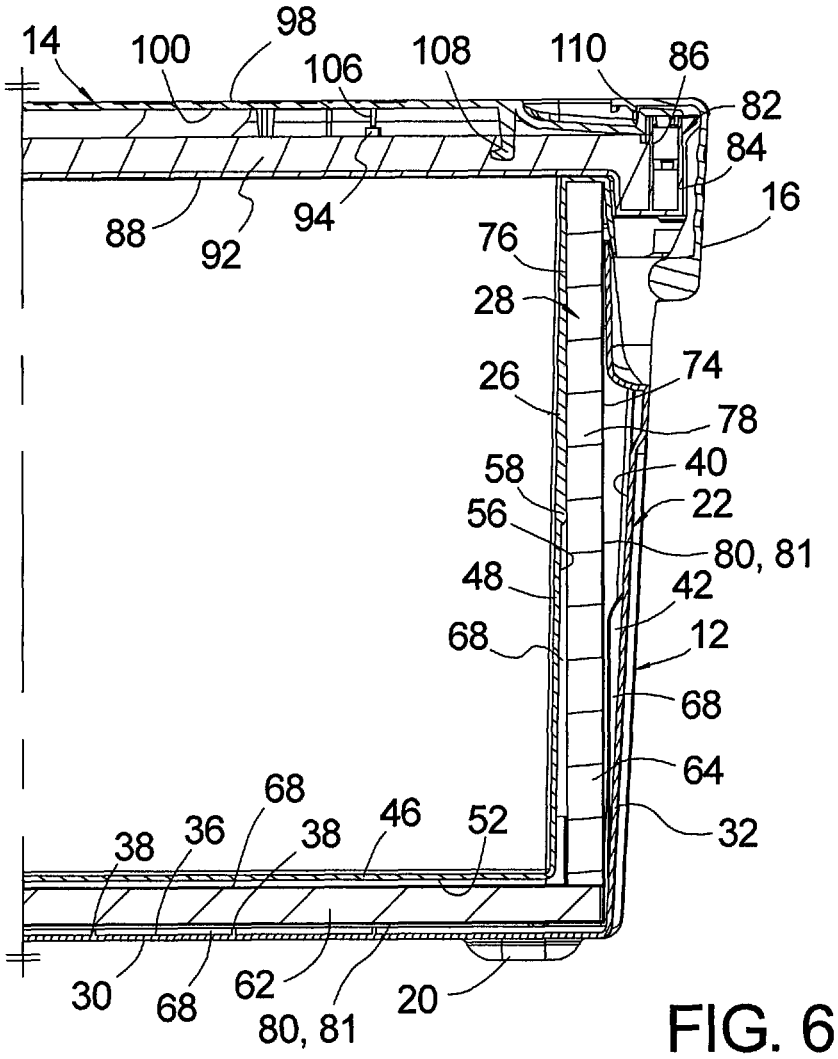
FIG. 6 is a cross-sectional view of the archive box taken along line 6-6 in FIG. 2.
Figure 7:
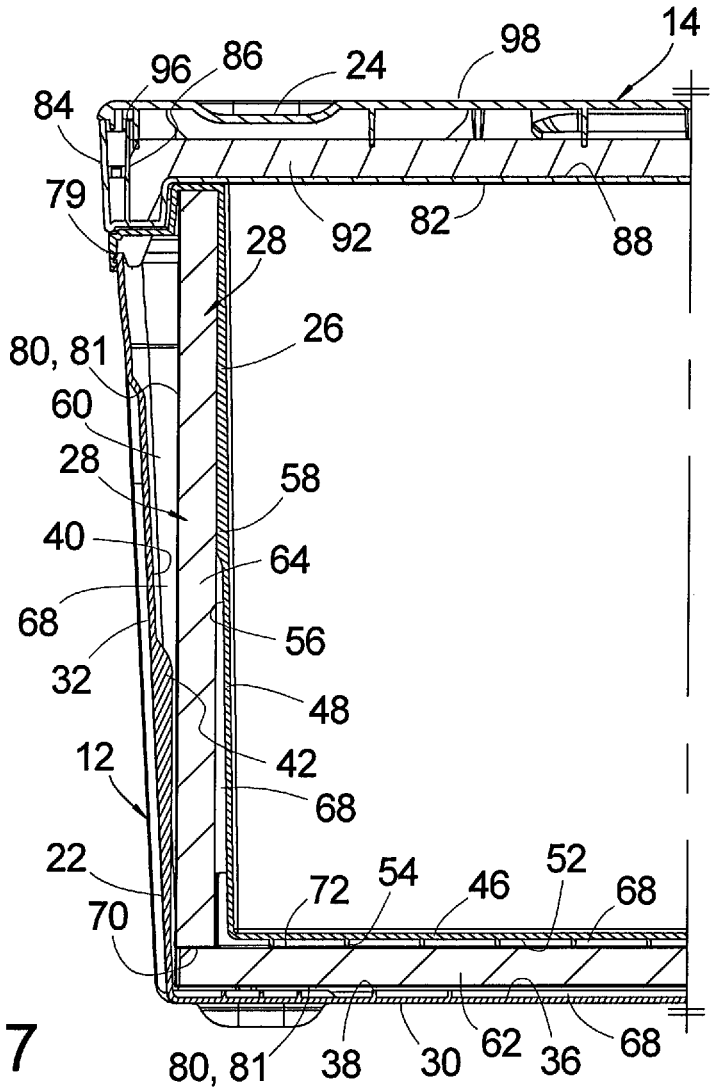
FIG. 7 is a cross-sectional view of the archive box taken along line 7-7 in FIG. 2.

As best seen in FIGS. 5-7, base assembly 12 includes outer shell 22, an inner shell 26, and a drywall support shell 28 positioned therebetween. Outer shell 22 may be formed from a polymeric resin, for example, high density polyethylene (HDPE), that has a melting point higher than the boiling point of water. Outer shell 22 may include a bottom wall 30 and at least one side wall 32, preferably four side walls, extending upwardly from bottom wall 30 defining an opening 34. As best seen in FIGS. 6 and 7, bottom wall 30 may include an inner surface 36 and at least one elongated spacing rib 38 extending outwardly from inner surface 36. As best seen in FIGS. 5-7, at least one of side walls 32 may include an inner surface 40 and at least one elongated spacing rib 42 extending outwardly from inner surface 40. Ribs 38 may extend parallel with respect to one another along inner surface 36 of bottom wall 30, and ribs 42 may extend parallel with respect to one another along inner surface 40 of side walls 32. Also, ribs 38 and 42 may extend along the entire length of bottom wall 30 or side walls 32, respectively, or only along a portion thereof. With reference to FIG. 5, one or more labels 44 may be adhered to side walls 32 to provide a location for identifying the contents of the archive box 10.

With continued reference to FIGS. 5-7, inner shell 26 may be formed from a polymeric resin, for example, HDPE, that has a melting point higher than the boiling point of water, and configured to be disposed within opening 34 of outer shell 22. In particular, inner shell 26 may include a bottom wall 46 and at least one side wall 48, preferably four side walls to correspond to the number of side walls included in outer shell 22, extending upwardly from bottom wall 46 defining an opening 50 and storage compartment 18. Further, as best seen in FIGS. 5 and 7, bottom wall 46 may include an outer surface 52 and at least one elongated spacing rib 54 extending outwardly from outer surface 52. With additional reference to FIG. 6, at least one of side walls 48 may include an outer surface 56 and at least one elongated spacing rib 58 extending outwardly from outer surface 56. Ribs 54 may extend parallel with respect to one another along outer surface 52 of bottom wall 46, and ribs 58 may extend parallel with respect to one another along outer surface 56 of side walls 48. Further, ribs 54 and 58 may extend along the entire length of bottom wall 46 or side walls 48, respectively, or only along a portion thereof.

When inner shell 26 is disposed within outer shell 22, inner shell 26 is spaced apart from outer shell 22 so that a drywall support shell 28 may be disposed within a cavity 60 defined between inner shell 26 and outer shell 22. As such, drywall support shell 28 would be inserted into outer shell 22 prior to inner shell 26 being inserted within opening 34 of outer shell 22. In the event of a fire, the temperature of outer shell 22 would likely increase to a level where it loses the ability to protect the contents contained within outer shell 22. Therefore, drywall support shell 28 is configured to surround at least a substantial portion of inner shell 26 to protect the contents contained within storage compartment of archive box 10 for a period of time in the event of a fire.

Drywall support shell 28 may include a bottom wall 62 positioned adjacent to and between bottom walls 30, 46 of inner and outer shells 22, 26. Drywall support shell 28 may also include at least one side wall 64 positioned adjacent to and between side walls 32, 48 of inner and outer shells 22, 26. It should be understood that bottom wall 62 and side walls 64 may either be separate pieces or one single integral piece. Further, bottom wall 62 is preferably positioned perpendicular with respect to each of the at least one side wall 64. As best seen in FIGS. 6 and 7, bottom wall 62 and side walls 64 of drywall support shell 28 may be spaced apart from outer and inner shells 22, 26 using ribs 38, 42, 54, 58 thereby creating air gaps 68 to assist with protecting the contents contained within inner shell 26. In particular, rib 54 may be in contact with bottom wall 62 of drywall support shell 28 to off-space bottom wall 62 from outer surface 52 of bottom wall 46 of inner shell 26, and rib 58 may be in contact with side wall 64 of drywall support shell 28 to off-space side wall 64 from outer surface 56 of side wall 48 of inner shell 26. Also, ribs 38 may be in contact with bottom wall 62 of drywall support shell 28 to off-space bottom wall 62 from inner surface 36 of bottom wall 30 of outer shell 22, and rib 42 may be in contact with side wall 64 of drywall support shell 28 to off-space side wall 64 from inner surface 40 of side wall 32 of outer shell 22.

As best seen in FIG. 5, one or more clips 66 may be used to align and fasten bottom wall 62 to side walls 64. In order to provide support for side walls 64 of drywall support shell 28, clips 66 may be used to position side walls 64 so that end portions 70 are in contact with, and rest on top of, a top surface 72 of bottom wall 62 of drywall support shell 28, as best seen in FIGS. 6 and 7.

The bottom wall 62 and/or at least one side wall 64 may be formed of gypsum board drywall, such as, for example, GOLD BOND® Gypsum Board manufactured by National Gypsum Company, 2001 Rexford Road, Charlotte, N.C. 28211. The gypsum board drywall may include an outer paper layer 74, an inner paper layer 76, and a core 78 including gypsum disposed between the outer and inner paper layers 74, 76. The core 78 may be formed from gypsum plaster, which is the semi-hydrous form of calcium sulfate ($CaSO_4.½H_2O$). Depending on the type of properties that are desired for core 78, when forming the gypsum board, the plaster may be mixed with fiber (e.g., paper, fiberglass), plasticizer, foaming agent, gypsum crystal, starch, and other additives that increase mildew and fire resistance. One or more of bottom wall 62 and at least one side wall 64 preferably have a thickness of about 0.5 inches, but it will be understood that other thickness may also be used depending on the amount of fire resistance that is desired and the desired weight of archive box 10.

As best seen in FIGS. 5-7, drywall support shell 28 may be entirely or partly surrounded by a thermal reflectant layer 80, such as, for example, aluminum foil or stainless steel. Thermal reflectant layer 80 operates to protect drywall support shell 28 in the event of a fire by reflecting heat that is directed at drywall support shell 28, thereby reducing the amount that outer paper layer 74 is burned when exposed to fire. The structural integrity of drywall support shell 28 is substantially upheld in the event of a fire and therefore better able to protect the contents positioned within the storage compartment 18. Thermal reflectant layer 80 may be adhesively attached to drywall support shell 28, or just wrapped around drywall support shell 28 without being adhesively attached thereto. If thermal reflectant layer 80 is used, then it should be understood that ribs 38, 42 on bottom wall 30 and side walls 32 will be in contact with thermal reflectant layer 80 instead of bottom wall 62 and side walls 64 of drywall support shell 28. After drywall support shell 28 is placed within cavity 60, along with thermal reflectant layer 80, as described above, inner shell 26 may be securely coupled with outer shell 22 by a snap fit or welding at location 79 to form base assembly 12.

Instead of, or in addition to, using thermal reflectant layer 80 to protect drywall support shell 28 in the event of a fire, an intumescent coating 81 may be sprayed, brushed, rolled, or otherwise applied to all, or part, of an outer surface of drywall support shell 28, as best seen in FIGS. 5-7. For example, intumescent coating 81 may take the form of a fireproof paint PTP DC333 manufactured by International Fireproof Technology Inc. of Irvine, Calif., which is described as a water-based Acrylic based paint. When intumescent coating 81 is exposed to high temperatures or a direct flame, between about 270° F. and about 350° F., an intumescent reaction takes place wherein the coating 81 absorbs the heat energy, undergoes a phase change by turning into a foam, and caramelizes forming a char-like barrier on the outer surface of drywall support shell 28. The intumescent coating 81 does not combust when exposed to high temperatures, and therefore increases the amount of time that the drywall support shell 28 can protect inner shell 26 in the event of a fire.

Figure 8:
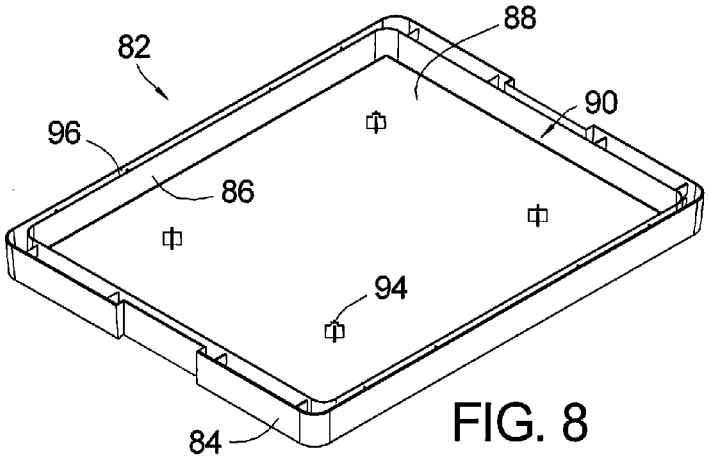
FIG. 8 is a top perspective view of a lid bucket that may be used to form the archive box shown in FIG. 1.
Figure 9:
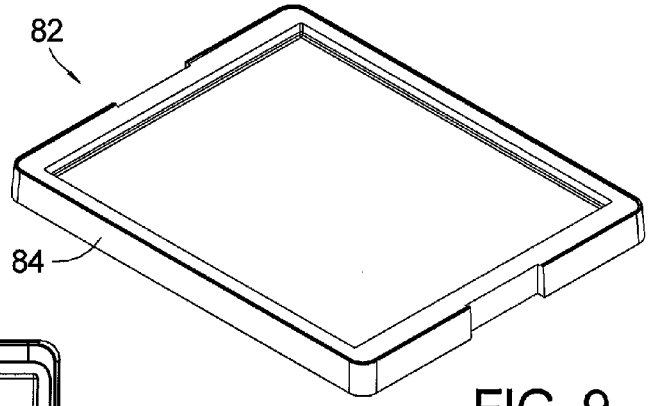
FIG. 9 is a bottom perspective view of the lid bucket shown in FIG. 8.
Figure 10:
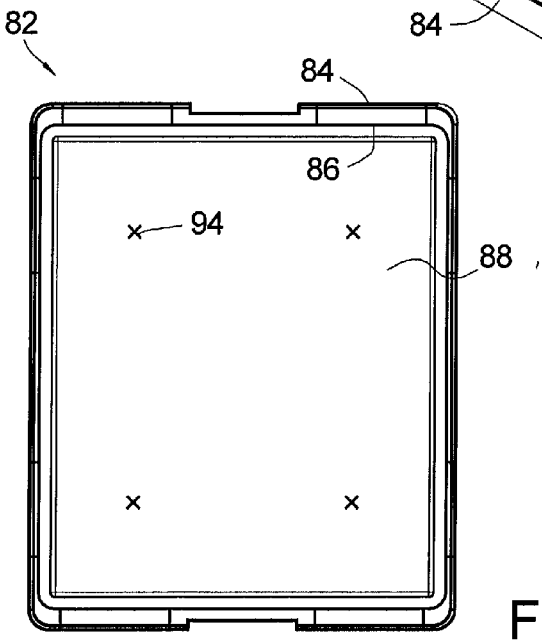
FIG. 10 is a top view of the lid bucket shown in FIG. 8.

As mentioned above, archive box 10 may further include a lid 14 that is configured to be disposed over opening 50 in inner shell 26 of base assembly 12 to selectively enclose storage compartment 18. As best seen in FIGS. 5-10, lid 14 may include a lid bucket 82 having an outer peripheral wall 84, an inner peripheral wall 86 disposed inwardly or outer peripheral wall 84, and a bottom wall 88. Inner peripheral wall 86 and bottom wall 88 define a fill cavity 90 that is configured for receiving a thermally resistant insulation material 92. The thermally resistant insulation material 92 may be a hydrated Portland cement having between approximately 40-60% water content and including nylon fibers. As best seen in FIGS. 5, 8 and 10, bottom wall 88 may include one or more fill protrusions 94 that serve as an indicator as to how much insulation material 92 to place in fill cavity 90, which is preferably a distance below an upper edge 96 of inner peripheral wall 86 (FIG. 7).

Figure 11:
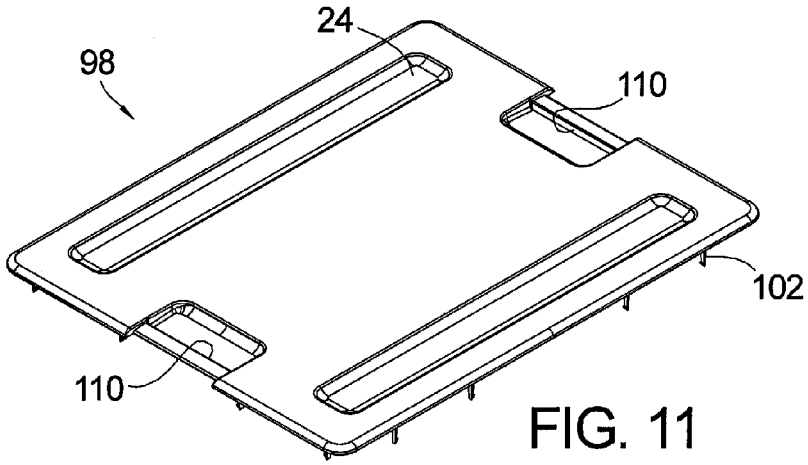
FIG. 11 is a top perspective view of a cover that may be used to form the archive box shown in FIG. 1.
Figure 12:
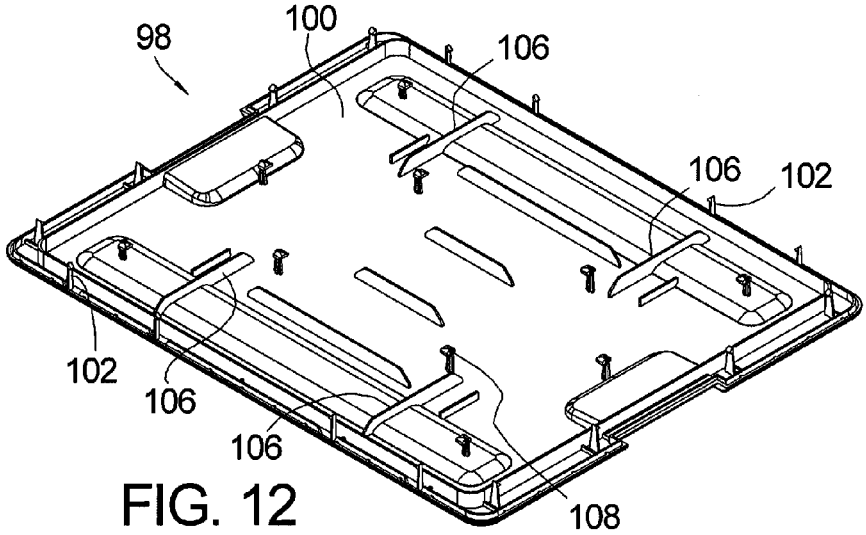
FIG. 12 is a bottom perspective view of the cover shown in FIG. 11.
Figure 13:
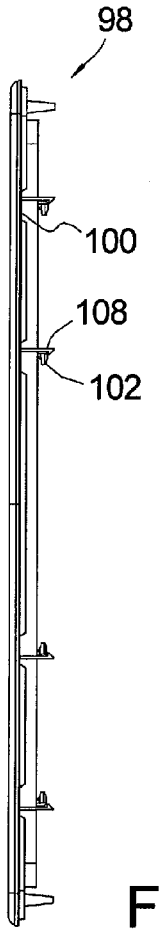
FIG. 13 is a side view of the cover shown in FIG. 11.
Figure 14:
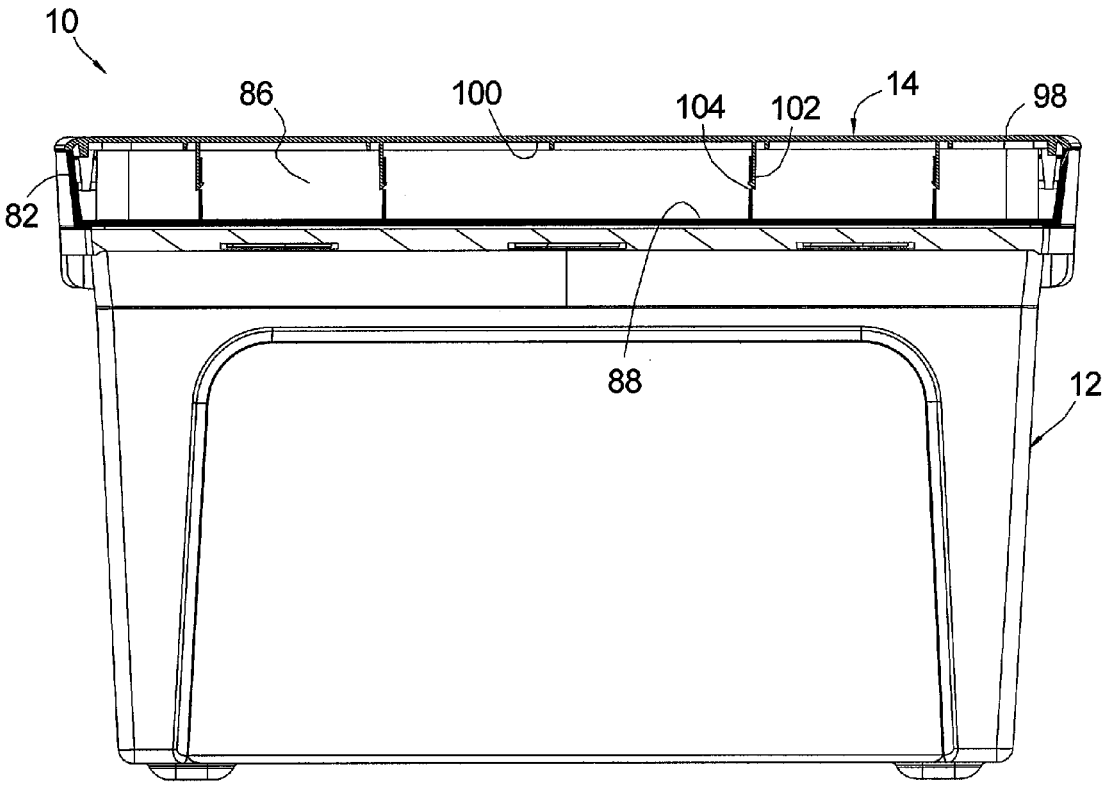
FIG. 14 is a cross-sectional view showing the cover coupled with the lid bucket taken along line 14-14 in FIG. 4.
Figure 15:
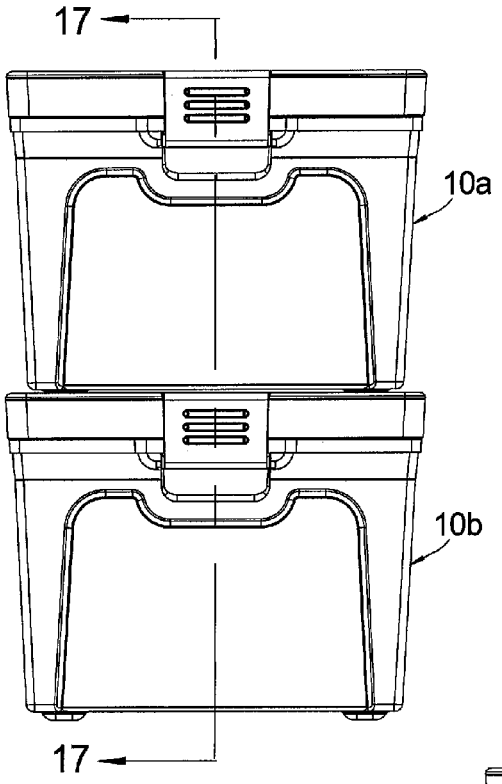
FIG. 15 is a front view of an archive box stacked on top of another archive box.
Figure 16:
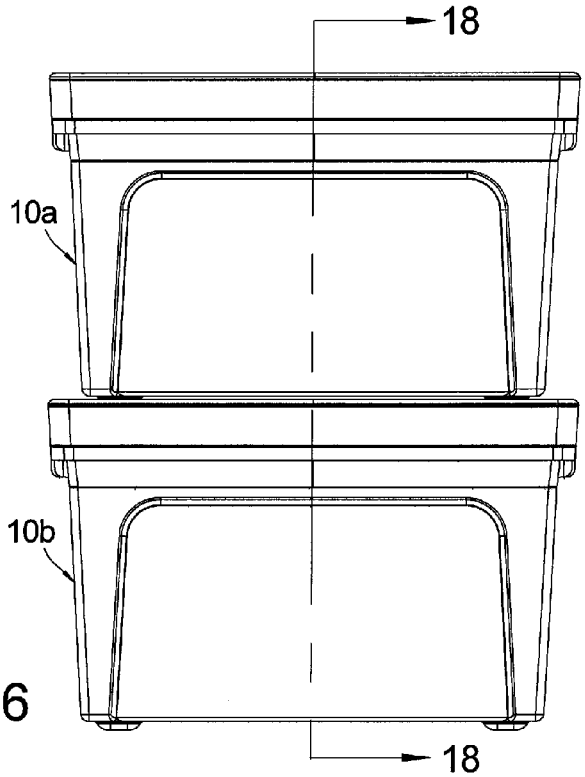
FIG. 16 is a side view of the stacked archive boxes shown in FIG. 15.

As best seen in FIGS. 5-7 and 11-13, lid 14 may further include a cover 98 that is configured to be coupled with lid bucket 82 and enclose insulation material 92 within fill cavity 90. Both cover 98 and lid bucket 82 may be formed of a polymeric resin, for example, HDPE, that has a melting point higher than the boiling point of water. Cover 98 may include an inner surface 100 including at lest one snap protrusion 102 extending therefrom that are adapted to be received within a corresponding number of receiving slots 104 (FIG. 14) defined in lid bucket 82 to fasten cover 98 to lid bucket 82. Receiving slots 104 are positioned between inner and outer peripheral walls 84, 86. As best seen in FIGS. 6 and 12, cover 98 may further include at least one brace protrusion 106 extending from inner surface 100 and positioned to come into contact with fill protrusion 94 to provide enhanced structural rigidity to lid 14. With additional reference to FIG. 13, inner surface 100 of cover 98 may also have one or more posts 108 extending therefrom that are configured to be positioned within insulation material 92 when it cures to anchor cover 98 to lid bucket 82. As best seen in FIGS. 6 and 11, cover 98 may include one or more latch grooves 110 for receiving a corresponding number of latches 16 when in a closed position to selectively couple base assembly 12 to lid 14.

As best seen in FIGS. 15-18, the present invention provides a system for stacking an upper archive box 10*a* on top of a lower archive box 10*b*, wherein a drywall support shell 28*b* of archive box 10*b* operates to support the weight of archive box 10*a* in the event of a fire and thereby protects the contents located within archive boxes 10*a*, 10*b*. When stacking archive box 10*a* on top of archive box 10*b*, support feet 20*a* of archive box 10*a* may be placed in corresponding indentations 24*b* formed in a lid 14*b* of archive box 10*b* in order to properly orient archive boxes 10*a*, 10*b* relative to one another. The use of indentations 24*b* in archive box 10*b* are advantageous in the instance that support feet 20*a* are used on archive box 10*a* because the gap between a cover 98*b* of archive box 10*b* and a bottom wall 30*a* of outer shell 22*a* of archive box 10*a* may either be minimized or eliminated to enhance the fire-resistance of the stacked archive box system. Of course, another way to minimize the gap between cover 98*b* of archive box 10*b* and bottom wall 30*a* of outer shell 22*a* of archive box 10*a* is to eliminate support feet 20*a* so that bottom wall 30*a* is in contact with cover 98*b*.

Archive boxes 10*a*, 10*b* are oriented relative to one another so that side walls 64*a* of drywall support shell 28*a* of archive box 10*a* are substantially vertically aligned with the corresponding side walls 64*b* of drywall support shell 28*b* of archive box 10*b*. For example, with reference to FIGS. 17 and 18, side walls 64*a* of drywall support shell 28*a* of the upper archive box 10*a* may be coplanar with the corresponding side walls 64*b* of drywall support shell 28*b* of the lower archive box 10*b* so that the load 113*a* of archive box 10*a*, and any contents located therein, are directed through side walls 64*b* of archive box 10*b* as shown with arrow 113*b*. By directing the load of the upper archive box 10*a* through side walls 64*b*, the lower archive box 10*b* is able to support archive box 10*a* when outer shell 22*b* loses its structural rigidity when exposed to heat generated by a fire. Otherwise, the lower archive box 10*b* would be susceptible to collapse, thereby increasing the chance that the contents within archive box 10*b* would be destroyed. It is also contemplated that side walls 64*a* of drywall support shell 28*a* of the upper archive box 10*a* be positioned inwardly of corresponding side walls 64*b* of drywall support shell 28*b* of the lower archive box 10*b*.

Figure 17:
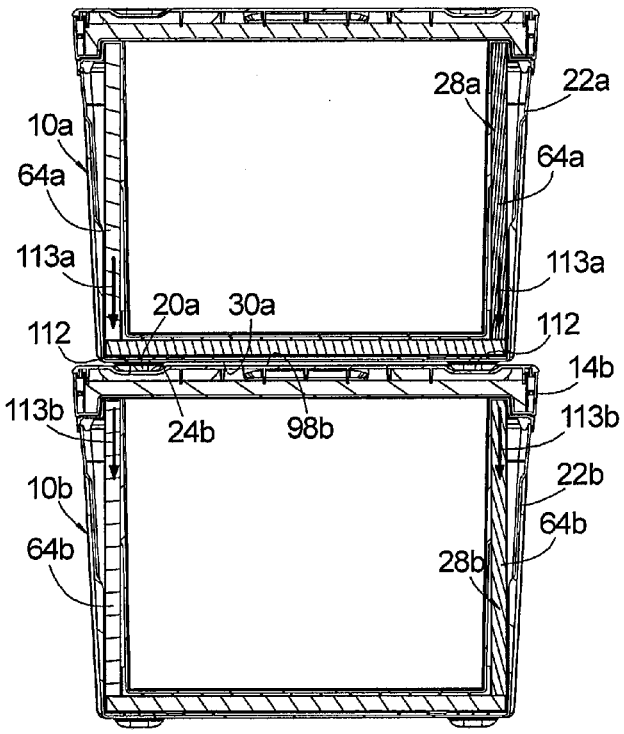
FIG. 17 is a cross-sectional view of the stacked archive boxes taken along line 17-17 in FIG. 15.
Figure 18:
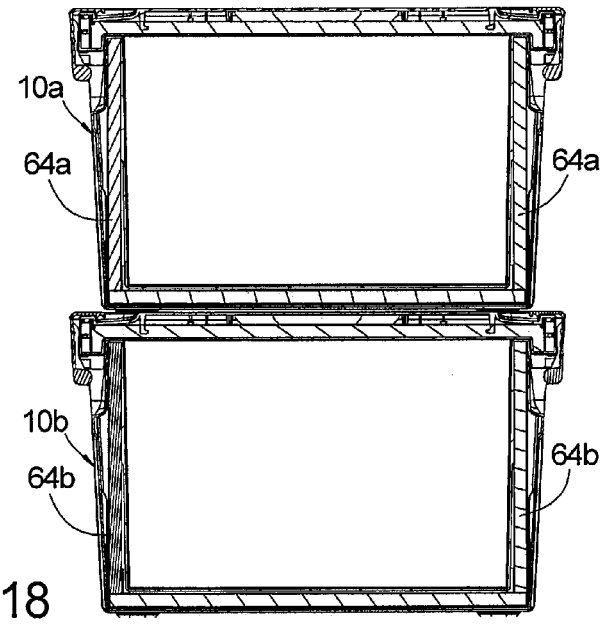
FIG. 18 is a cross-sectional view of the stacked archive boxes taken along line 18-18 in FIG. 16.

In the case where support feet 20*a* are used on the upper archive box 10*a*, the point of contact between upper archive box 10*a* and lower archive box 10*b* is the interface between support feet 20*a* and cover 98*b*, which is hereby identified as the load transmission point 112 (FIG. 17). The load of archive box 10*a*, and any load imposed by the contents contained therein, will pass through a load transmission point prior to being transferred to side walls 64*b* of lower archive box 10*b*. It should be understood that load transmission point 112 is preferably positioned in alignment with at least one of side walls 64*b* or inwardly of side walls 64*b* to reduce the possibility that lower archive box 10*b* will collapse in the event of a fire.

The system of stacking archive boxes as described above provides a number of advantages. For example, each of the archive boxes that are used in the above-referenced system comprise a base assembly including a drywall support shell and a lid including thermally resistant insulation material, and therefore provide extended protection to contents stored within each archive box in the event of a fire. In addition, the orientation of the drywall support shell in each of the stacked archive boxes allows for a transfer of load from the upper archive box to the lower archive box, which prevents the premature collapse of the lower archive box in the event of a fire, thereby protecting the contents located within the lower archive box. Furthermore, the use of support feet on the upper archive box which are configured to be disposed in indentations formed in the lid of the lower archive box provides proper alignment of the upper archive box relative to the lower archive box, which in turn results in the lower archive box sustaining its structural integrity for a lengthened period of time in the event of a fire.

Although the present invention has been described in considerable detail with reference to certain preferred versions thereof, other versions are possible. Therefore, the spirit and scope of the appended claims should not be limited to the description of the preferred versions contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A system for stacking a first archive box on top of a second archive box, wherein said first archive box and said second archive box each comprise:

an outer shell;

an inner shell disposed within said outer shell, said inner shell having an opening defining a storage compartment, said inner shell being spaced apart from said outer shell defining a cavity between said inner shell and said outer shell, said inner shell including a bottom wall and at least one side wall;

a gypsum board drywall support shell disposed within said cavity and surrounding a substantial portion of said inner shell, said drywall support shell including a bottom wall positioned adjacent to said bottom wall of said inner shell, said drywall support shell including at least one side wall positioned adjacent to said at least one side wall of said inner shell; and a lid configured to be disposed over said opening in said inner shell to selectively enclose said storage compartment, wherein said at least one side wall of said drywall support shell of said first archive box is substantially aligned with said at least one side wall of said drywall support shell of said second archive box whereby said second archive box is supportive of said first archive box.

2. A system in accordance with claim 1, wherein said at least one side wall of said drywall support shell of said first archive box is coplanar with said at least one side wall of said drywall support shell of said second archive box.

3. A system in accordance with claim 1, wherein said first archive box includes at least one support foot extending from said outer shell, wherein said second archive box includes an indentation defined in said lid configured for receiving said at least one support foot.

4. A system in accordance with claim 1, for at least one of said first archive box or said second archive box, said bottom wall of said inner shell including an outer surface and at least one rib extending outwardly from said outer surface, wherein said at least one rib is in contact with said bottom wall of said drywall support shell to off-space said bottom wall of said drywall support shell from said outer surface of said bottom wall of said inner shell.

5. A system in accordance with claim 1, for at least one of said first archive box or said second archive box, said at least one side wall of said inner shell including an outer surface and at least one rib extending outwardly from said outer surface, wherein said at least one rib is in contact with said at least one side wall of said drywall support shell to off-space said at least one side wall of said drywall support shell from said outer surface of said at least one side wall of said inner shell.

6. A system in accordance with claim 4, for at least one of said first archive box or said second archive box, said outer shell including a bottom wall and at least one side wall, wherein said bottom wall of said outer shell includes an inner surface and at least one rib extending outwardly from said inner surface, wherein said at least one rib is in contact with said bottom wall of said drywall support shell to off-space said bottom wall of said drywall support shell from said inner surface of said bottom wall of said outer shell.

7. A system in accordance with claim 5, for at least one of said first archive box or said second archive box, said outer shell including a bottom wall and at least one side wall, wherein said at least one side wall of said outer shell includes an inner surface and at least one rib extending outwardly from said inner surface, wherein said at least one rib is in contact with said at least one side wall of said drywall support shell to off-space said at least one side wall of said drywall support shell from said inner surface of said at least one side wall of said outer shell.

8. A system in accordance with claim 1, for at least one of said first archive box or said second archive box, said at least one side wall of said drywall support shell includes an end portion, wherein said bottom wall of said drywall support shell includes a top surface, and wherein said end portion is in contact with said top surface.

9. A system in accordance with claim 1, for at least one of said first archive box or said second archive box, said bottom wall and said at least one side wall of said drywall support shell have a thickness of about 0.5 inches.

10. A system in accordance with claim 1, for at least one of said first archive box or said second archive box, said bottom wall and said at least one side wall of said drywall support shell each include an outer paper layer, an inner paper layer, and an inner core including gypsum disposed between said inner and outer layers of paper.

11. A system in accordance with claim 1, wherein at least one of said first archive box and said second archive box further comprise a thermal reflectant layer surrounding a substantial portion of said drywall support shell, wherein said thermal reflectant layer is positioned between said drywall support shell and said outer shell.

12. A system in accordance with claim 11, wherein said thermal reflectant layer is selected from the group consisting of aluminum foil and stainless steel.

13. A system in accordance with claim 1, wherein at least one of said first archive box and said second archive box further comprise an intumescent coating surrounding a substantial portion of said drywall support shell, wherein said intumescent coating is disposed on an outer surface of said drywall support shell.

14. A system in accordance with claim 1, for at least one of said first archive box or said second archive box, said lid includes a lid bucket defining a fill cavity, a cover coupled with said lid bucket to enclose said fill cavity, and thermally resistant insulation positioned within said fill cavity.

15. A system in accordance with claim 14, wherein said lid bucket includes a bottom wall having at least one fill protrusion extending therefrom.

16. A system in accordance with claim 15, wherein said cover includes an inner surface having at least one brace protrusion extending therefrom positioned to contact said at least one fill protrusion on said lid bucket.

17. A system in accordance with claim 14, wherein said cover includes an inner surface having at least one post extending therefrom, said at least one post being embedded in said thermally resistant insulation.

18. A system in accordance with claim 14, wherein said cover includes an inner surface having at least one snap protrusion extending therefrom, wherein said lid bucket includes at least one receiving slot defined therein configured to receive said snap protrusion to fasten said cover to said lid bucket.

19. A system in accordance with claim 1, wherein at least one of said first archive box and said second archive box further comprise at least two latches pivotally coupled with one of said outer shell and said lid, wherein said at least two latches are configured to be selectively engaged with the other of said outer shell and said lid to couple said lid to said outer shell.

20. A system for stacking a first archive box on top of a second archive box, wherein said first archive box and said second archive box each comprise:

an outer shell including a bottom wall and at least one side wall, said outer shell including at least one support foot extending therefrom;

an inner shell including a bottom wall and at least one side wall, said inner shell disposed within said outer shell, said inner shell having an opening defining a storage compartment, said inner shell being spaced apart from said outer shell defining a cavity between said inner shell and said outer shell;

a gypsum board drywall support shell disposed within said cavity and surrounding a substantial portion of said inner shell, said drywall support shell including a bottom wall spaced apart from said bottom wall of said inner shell and said bottom wall of said outer shell, said drywall support shell including at least one side wall that is spaced apart from said at least one side wall of said inner shell and said at least one side wall of said outer shell, said at least one side wall of said drywall support shell including an end portion, said bottom wall of said drywall support shell including a top surface, wherein said end portion is in contact with said top surface;

a thermal reflectant layer surrounding at least a substantial portion of said drywall support shell, wherein said thermal reflectant layer is positioned between said drywall support shell and said outer shell; and a lid configured to be disposed over said opening in said inner shell to selectively enclose said storage compartment, said lid including an indentation defined therein configured for receiving said at least one support foot of said first archive box, wherein said at least one side wall of said drywall support shell of said first archive box is substantially vertically aligned with, or positioned inwardly of, said at least one side wall of said drywall support shell of said second archive box whereby said second archive box is supportive of said first archive box.

21. A system for stacking a first archive box on top of a second archive box, wherein said first archive box and said second archive box each comprise:

an outer shell including a bottom surface;

an inner shell disposed within said outer shell, said inner shell having an opening defining a storage compartment, said inner shell being spaced apart from said outer shell defining a cavity between said inner shell and said outer shell, said inner shell including a bottom wall and first and second opposing side walls;

a gypsum board drywall support shell disposed within said cavity and surrounding a substantial portion of said inner shell, said drywall support shell including a bottom wall positioned adjacent to said bottom wall of said inner shell, said drywall support shell including at least first and second opposing side walls positioned adjacent to said first and second opposing side walls of said inner shell, respectively; and a lid configured to be disposed over said opening in said inner shell to selectively enclose said storage compartment, wherein said bottom surface of said outer shell of said first archive box is in contact with said lid of said second archive box to form at least one load transmission point, and wherein said at least one load transmission point is positioned inwardly of said first and second opposing side walls of said drywall support shell of said second archive box whereby said second archive box is supportive of said first archive box.

* * * * *